United States Patent [19]

Svilar et al.

[11] Patent Number: 4,731,118

[45] **Date of Patent: * Mar. 15, 1988**

[54] HIGH IMPACT STRENGTH POWER METAL PART AND METHOD FOR MAKING SAME

[75] Inventors: Mark Svilar, University Hts.; Erhard Klar, Beachwood, both of Ohio

[73] Assignee: SCM Metal Products, Inc.

[ * ] Notice: The portion of the term of this patent subsequent to Aug. 19, 2003 has been disclaimed.

[21] Appl. No.: 935,854

[22] Filed: Nov. 28, 1986

Related U.S. Application Data

[63] Continuation-in-part of Ser. No. 879,502, Jun. 25, 1986, abandoned, which is a continuation-in-part of Ser. No. 866,184, May 20, 1986, abandoned.

[51] Int. Cl.[4] ..... B22F 1/00

[52] U.S. Cl. ..... 75/246; 75/244; 75/247; 419/27; 419/29; 419/57; 419/58; 419/60

[58] Field of Search ..... 75/244, 246, 247; 419/27, 58, 60, 29, 57

[56] References Cited

U.S. PATENT DOCUMENTS 4,123,265 10/1978 Takahashi ..... 75/211
4,606,768 8/1986 Svilar et al. ..... 75/246

*Primary Examiner*—Stephen J. Lechert, Jr.
*Attorney, Agent, or Firm*—R. A. Sturges

[57] ABSTRACT

A copper or copper alloy infiltrated ferrous powder metal part, and method for making the same, characterized as having after infiltration an overall density of at least 7.50 g/cm$^3$ and a diffusion depth of copper into the steel matrix of less than about 4 micrometers as determined by chemical etching or less than about 8 micrometers as determined by electron dispersive X-ray analysis (EDXA), wherein said ferrous metal is plain carbon steel having a combined carbon content in the range of about 0.15% to about 1.25%, or a low alloy steel.

38 Claims, 5 Drawing Figures

PHOTOGRAPHS SHOWING DEFORMATION DURING IMPACT TESTING. TOP SPECIMEN INFILTRATED 5 MINUTES (174 FT.-LBS.) BOTTOM SPECIMEN INFILTRATED 90 MINUTES (101 FT.-LBS.) (APPROXIMATELY ACTUAL SIZE)

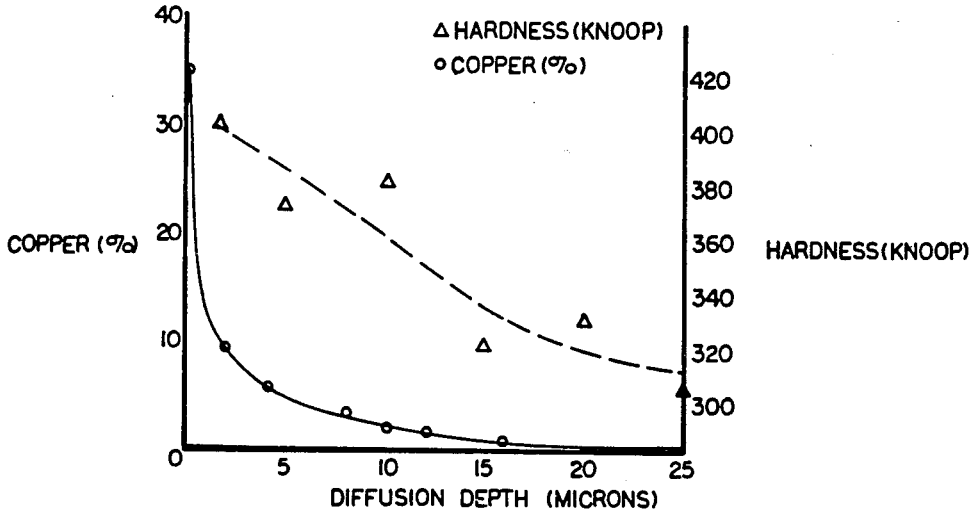
FIG. 3 RELATIONSHIP BETWEEN COPPER CONTENT AND MICROHARDNESS OF DIFFUSION LAYER
INFILTRATION 90 MINS. AT 2050°F.
QUENCHED AND TEMPERED CONDITION
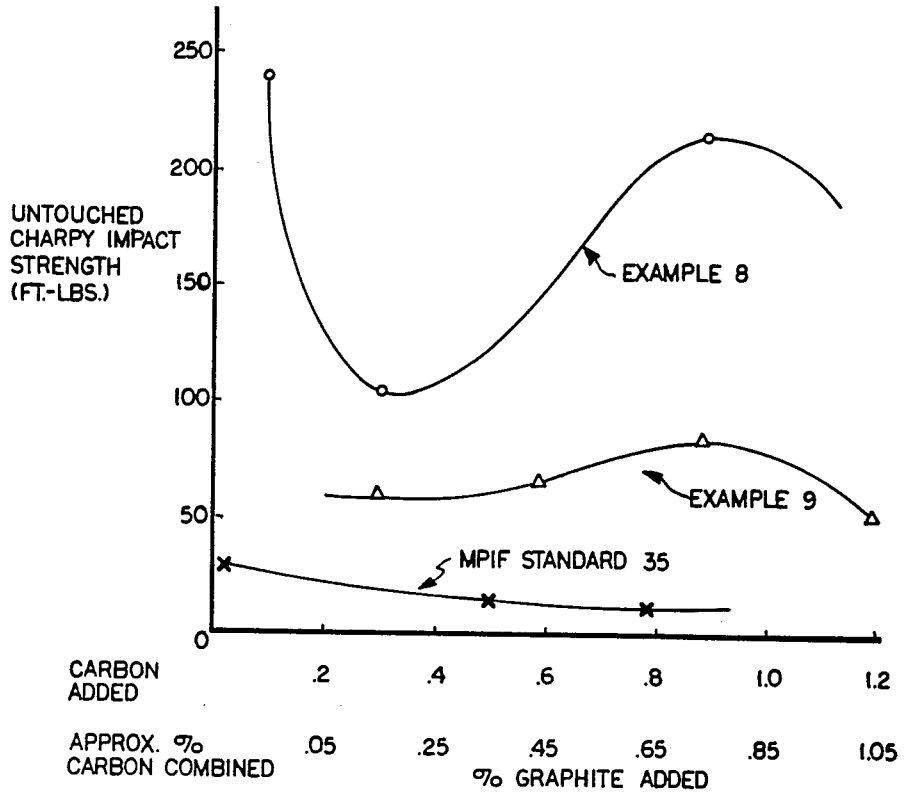
FIG. 5

HIGH IMPACT STRENGTH POWER METAL PART AND METHOD FOR MAKING SAME

RELATED CASES

This application is a continuation in part of our copending application Ser. No. 879,502 filed June 25, 1986, now abandoned which application was in turn a continuation in part of our copending application Ser. No. 866,184 filed May 20, 1986, now abandoned.

TECHNICAL FIELD

The present invention relates to the preparation of copper infiltrated powder metal parts.

BACKGROUND OF THE PRESENT INVENTION

Parts made from the state of the art powder metallurgy, i.e., pressed and sintered or infiltrated, have very low impact strengths—typically only 3 to 20 ft. lbs measured by the unnotched Charpy Test. Higher impact strength would enable these low cost methods to be used for higher performance parts that are now made by alternative technologes that are more expensive, i.e., powder metal forging, hot pressing, injection molding, etc.

Copper in iron is known to enable the iron to precipitation harden. Iron also can be hardened by adding carbon and heat treating. The use of carbon and heat treatment is least expensive and virtually the most common way the strength and toughness of steel is controlled.

Prior patent application Ser. No. 755,282, filed July 15, 1985, now U.S. Pat. No. 4,606,768 dated Aug. 19, 1986, assigned to assignee of the present application, describes how to significantly improve impact strength of copper infiltrated steel by assuring the absence of erosion and local porosity (defined statistically in terms of pore volume and maximum pore size). Unnotched Charpy impact strengths as high as 130 ft. lbs at an ultimate tensile strength of 103 ksi have been obtained. High combinations of impact and ultimate tensile strength are sought in many engineering applications. The disclosure of U.S. Pat. No. 4,606,768 is incorporated by reference herein.

State of the art copper infiltration of iron and steel parts uses long infiltration times to insure the most complete infiltration possible and improve tensile strength. Typically, the times range from 30 minutes to 90 minutes, although shorter infiltration times have been reported. For these times there is partial alloying of the copper with the iron due to dissolving and reprecipitation of the iron because of liquid phase sintering as well as solid state diffusion of the coppper into the iron. In the areas where copper and iron are both present, optimizing heat treatment for impact toughness is complicated by both carbon and copper hardening mechanisms operating at the same time.

Several investigators (see U.S. Pat. No. 4,606,768) have attempted to obtain higher combinations of impact strength and tensile strength. Some of these investigators (i.e., Kuroki et al in 1973, Impact Properties of Copper Infiltrated Sintered Iron; Journal Japan Society Powder Metallurgy, July, 1973, Vol 20, pages 71–79) have employed short infiltlration times but were unable to obtain the desirable and large improvements reported herein. The Kuroki et al best combinations for tensile strength and impact strength were 84 ksi and 11 ft. lbs.; 57 ksi and 42 ft. lbs; and 43 ksi and 83 ft. lbs., respectively. The impact strength foot pound data was obtained by conversion from kilogram meters data given in FIG. 2 of the paper, which is based on centimeters squared. The data of highest impact strength was obtained with 100 sec. infiltration time; that of highest tensile strength at 135 min. infiltration time. It is indicated in the Kuroki et al paper that the tests were carried out on notched test pieces which were $8\times8\times40$ mm in dimension. The notches were described as being U-shaped, having a depth of 1.6 mm with a 1 mm base radius. Conventionally the Charpy Impact Test for powder metal parts is carried out with unnotched test pieces which are $10\times10$ mm in cross-section. In terms of cross-section, the Kuroki et al specimens are nonstandard, specifically about 64/100 the size of the parts conventionally tested by the Charpy test.

Notching will have an adverse effect on impact strength. On the other hand, it is well known that the smaller the specimen the better its ductility and toughness. It can be expected that the loss in strength due to notching vs unnotched would be off-set to a greater or lesser degree by the increase in strength due to the use of small-sized specimens. However, it is impossible to correlate the Kuroki et al method of testing with the standard Charpy test. This, plus the lack of certain information in Kuroki et al on the iron powder used, which is believed to be no longer available, or their method of preparation of samples, also makes it impossible to verify the results of Kuroki et al.

One significant fact to note in the Kuroki et al data is that as the impact strength is increased, this is at the expense of tensile strength. They give no data showing improvement at the same time in both tensile strength and impact strength.

One reason for the lower values of Kuroki et al may be improper combinations of carbon content and heat treatment. All of the Kuroki et al data was obtained with carbon-free material.

In this respect, it is well known that the addition of carbon to iron decreases ductility and elongation and would have, as a general rule, an adverse affect on impact strength. It may have been for this reason that Kuroki et al used carbon-free materials.

DISCLOSURE OF INVENTION

We have now discovered that it is possible to achieve even better combinations of impact strength and ultimate tensile strength by controlling the microstructure of the infiltrated steel in such a way that the diffusion of copper into the steel matrix is kept within a certain range. Control of the cleanliness of the steel matrix affords an additional improvement. In combination with the process descriptions of U.S. Pat. No. 4,606,768, it is then possible to obtain impact strengths (unnotched Charpy) of over 240 ft. lbs. at ultimate tensile strengths of over 100 ksi. Conversely, with this improvement it is now possible to obtain unnotched Charpy impact strengths of 50 ft. lbs. at a tensile strength of over 100 ksi at alow infiltrated overall density of about 7.55 g/cm$^3$. At such a low overall density, conventional processing typically gives an unnotched Charpy impact strength of less than 20 ft. lbs.

More specifically, the present invention resides in a copper infiltrated ferrous powder metal part infiltrated with copper or a copper alloy characterized as having after infiltration an overall density of at least 7.50 g/cm$^3$ and a diffusion depth of copper into the steel matrix of less than about 4 micrometers as determined by chemical etching or less than about 8 micrometers as determined by electron dispersive X-ray analysis (EDXA).

Preferably, the metal part has a diffusion depth less than about 3 micrometers as determined by chemical etching or less than about 5 micrometers as determined by EDXA.

An important aspect in the present invention, towards staying within the diffusion depth parameters stated above, is employing as the powder metal an iron powder having a carbon content in the range of about 0.3 to about 1.4 percent, based on the weight of the copper-free skeleton. The percent carbon is the amount (wt. %) of carbon added to the iron powder for preparing a so-called green part. During sintering and infiltrating, a portion of this carbon is lost due to the formation of carbon monoxide and carbon dioxide, the oxygen content of the iron powder being the source of oxygen. Carbon may also be lost through the formation of hydrocarbons with the hydrogen of the sintering atmosphere. Typical carbon losses due to these causes amounts to about 0.10 to 0.20%, or an average of about 0.15%, based upon the copper-free steel skeleton.

In the Examples herein, which are method examples, the percent carbon, for the purpose of convenience, is generally expressed in terms of percent carbon (or graphite) added. The percent carbon remaining (combined carbon) where given is the percent carbon added minus 0.15%, based on the steel skeleton only, i.e., not counting the amount of copper added to the part by infiltration. Accordingly, in terms of combined carbon or the carbon analysis of a finished part, the critical range is between about 0.15 percent and about 1.25%. A preferred range is about 0.25% to about 1.05%. It is understood that the percent carbon added can be in the form of carbon blended in with the iron powder (as graphite) or carbon alloyed with the iron.

Although not to be bound by a particular theory, it is believed that these percents carbon inhibit the diffusion of the copper into the ferrous metal particles during infiltration, and in so inhibiting diffusion, more than offset the negative aspect of the addition of carbon on impact strength. Optimum results have been obtained with an added carbon content of about 0.9%

As an alternative to carbon, or in combination with carbon, one can employ about 0.1% to about 0.2% of an additive such as boron, which will inhibit diffusion in the same manner as carbon.

The "diffusion depth" of copper is determined by measuring the copper concentration at various depths, for instance one, two or three micrometers, and plotting the copper concentration data against depth data on semi-logarithmic paper.

The copper concentration is plotted along the linear scale starting from zero, and the depth is plotted along the logarithmic scale starting from zero. The connection of the experimental points forms approximately a straight line and the "diffusion depth" is the point of intersection of the straight line with the logarithmic scale at zero percent copper concentration.

In those cases where the iron or steel contains prior to infiltration a more or less uniformly distributed base amount of coper, (a base concentration, for instance about several percent copper, can be tolerated) the same procedure for determining diffusion depth is employed, except that only the experimental points close to the surface of the steel particle are used to form said straight line. A new base line is then drawn parallel to the logarithmic scale at the level of the base amount of copper, and then the point of intersection obtained by extrapolation of the straight line with the new base line establishes the "diffusion depth".

The present invention also resides in a process for infiltrating ferrous powder metal parts with a copper or copper alloy infiltrant to yield an impact strength as measured by the unnotched Charpy test, of greater than 50 ft. lbs., and an ultimate tensile strength of greater than 60 ksi, comprising the steps of (a) pressing a ferrous powder metal to a density of at least about 80% of theoretical density; (b) sintering said powder metal preferably under vacuum sintering conditions; (c) infiltrating said powder metal with a copper or copper alloy infiltrant assuring that the depth of copper diffusion into the steel matrix as measured by chemical etching is less than about 4 micrometers or less than about 8 micrometers when determined by electron dispersive X-ray analysis.

The present invention will become more apparent upon consideration of the following specification with reference to the accompanying drawings in which:

FIG. 3 is a graph showing the change in microhardness through a carbon steel particle using data taken from a specimen which was infiltrated for 90 minutes, and then austenitized, quenched and tempered at 1300° F.;

FIG. 5 is a graph showing the variation in impact strength with percent graphite added for samples infiltrated for short times (Example 8 data) and for samples infiltrated for long times (Example 9 data).

BEST MODE FOR CARRYING OUT THE INVENTION & INDUSTRIAL APPLICABILITY

For purposes of the present application, the term "powder metal iron or steel" includes plain carbons steels, tool steels, stainless steels, and low alloy steels such as 4600. Typical alloying elements may be nickel, molybdenum, chromium, silicon and boron. Tool steels may contain such elements as vanadium and tungsten.

Also, in a preferred embodiment the infiltrant is copper containing typically an alloying constituent such as iron, tin, zinc, silver, lithium, silicon, manganese, chromium, zirconium, and combinations thereof.

The carbon content, with use of a non-alloy steel, is important.

Preferably, as indicated, it is within the range of about 0.1% to about 1.1%. Best results have been obtained with carbon contents of about 0.9%.

A preferred method of the present invention resides broadly in the steps of carefully filling a die with powdered metal to obtain uniform distribution of powder metal within said die. This includes drawing an instrument across the surface of the die to assure a level fill or surface of the powder metal in the die. At this point, the powder metal is subjected to pressing to obtain a density of at least about 80% of theoretical or full density.

Then, the powder metal is subjected to vacuum sintering under conventional sintering conditions (vacuum and temperature), which may vary with the powdered metal being employed. A vacuum of about 0.3 Torr is representative. Vacuum sintering is then followed by infiltration employing conventional infiltrating temperatures. However, the infiltration is also carried out under vacuum to eliminate residual gases which may be trapped in the pores. Preferably, these steps are followed by heat treatment through austenitizing and tempering to improve the ductility of the powder metal part.

Preferably, the infiltration is carried out in a short time, e.g., less than fifteen minutes, preferably less than seven minutes, as will be discussed in the following Example 2. It is believed that a short infiltration time, in combination with the percent added carbon, is an important factor towards staying within the diffusion depth parameters set forth above.

Short infiltration times also are advantageous from the point of view of dimensional control of the part.

Copper infiltration is known to lead to a swelling of a part due to the solution of copper in the steel and the penetration of copper in between particles. This growth is approximately linearly proportional to the length of infiltration. Thus, shorter infiltration times, apart from economic savings, are beneficial in that they keep growth desirably small and more reproducible.

Figure 4:
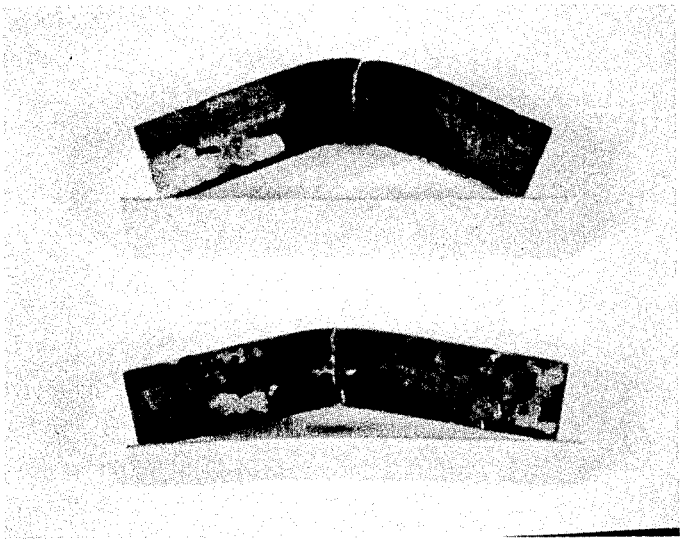
FIG. 4 shows the relative deformations after impact testing for samples infiltrated for 5 and 90 minutes as well as their respective impact strengths.

FIG. 4 shows the relative deformations for samples infiltrated for 5 and 90 minutes as well as their respective impact strengths.

It also follows from the above the desirable microstructures should be obtainable not only by using short infiltration times but by using additives (for instance boron) that reduce the rate of copper diffusion into the steel matrix.

In this regard, the presence of carbon, or use of carbon steel, has been found to be important, the presence of carbon also tending to reduce the rate of copper diffusion into the steel matrix. As indicated, optimum results have been obtained using 0.9% carbon steel.

In the specification and Examples, the infiltration and sintering are generally carried out in separate successive steps. It is understood that the advantages of the present invention can be realized by carrying out these two steps in a single step process, as shown in Example 13.

Desirably, the above is carried out in such a way as to obtain a microstructure as called for in copending application U.S. Pat. No. 4,606,768, specifically, the part having a worst field of view uninfiltrated porosity in a functionally critical area of less than about 10 volume percent and a maximum pore size of residual uninfiltrated porosity of less than about 120 micrometers.

For purposes of the present invention, the "critical area" is defined as that area adjacent a fractured surface of an infiltrated part subjected to failure obtained by clean cutting-off the fractured surface and polishing the cut area. The "worst field of view" is obtained by viewing and analyzing a plurality of views of the cut polished surface. In the present invention, 50 fields of view are analyzed to obtain a worst field of view. Residual uninfiltrated porosity and maximum pore size data is obtained by measurement udner magnification. The volume percent porosity is obtained from the area measurement following a procedure outlined in pages 446–449 of the National Bureau of Standards Publication 431, dated January, 1976 (incorporated by reference herein).

As an alternative to vacuum sintering and infiltration, good results can be obtained by sintering and infiltrating under a hydrogen atmosphere.

The following examples are illustrative of the concepts of the present invention. In the following Examples, tensile strength is given in terms of kips per square inch (ksi). One kip equals 1000 pounds. Density is given in terms of grams per cubic centimeter (g/cc). Carbon, copper and alloy percents are weight percents based on the weight of the iron or steel skeleton without these ingredients, unless otherwise specified. Screen sizes are U.S. Standard Screen Sizes.

EXAMPLE 1

Izod impact specimens (MPIF Std. 40) were pressed from commercially available atomized iron (marketed by Hoeganaes under the trademark Ancorsteel 1000) blended with 0.9% graphite and 0.75% zinc stearate. The pressing was carried out to a density of 6.70 g/cm$^3$, or about 85% of theoretical. Special care was taken to assure uniform and even die fill.

Sintering was consistent under vacuum, using helium at a partial pressure of 300 millimeters mercury (0.3 Torr). The sintering cycle was 1400° F. for 30 minutes and 2050° F. for 30 minutes. Cooling time to room temperature was about 1 hour. A minimal erosion infiltrant slug (SCM Metal Products' IP-204, a prealloyed copper infiltrant having 2–3% iron, 0.5–1.5% manganese, other 0.5–1.0%, lubricant 0.5%), weighing 21% of the impact specimen, was placed on top of one end of the specimen and infiltration was carried out under vacuum using the same cycle as described for the sintering treatment except that the length of time at 2050° F. was 7 minutes instead of 30 minutes. The weight of the slug was sufficient to provide about 10% excess infiltrant over that calculated to fill the pores.

The infiltrated specimens were then austenitized by placing them in a furnace at 1652° F. for 30 minutes (the specimens were at the temperature of 1652° F. for approximately 10 minutes) followed by an oil quench and tempering for 1 hour at 1300° F. under an inert atmosphere.

The Izod bar length was then reduced to that of the standard Charpy bar (MPIF Standard 40). Impact values obtained were 163 and 173 foot pounds for a set of two bars. The tensile strength of the dog bone tensile bars (MPIF Standard 10) processed the same way as the impact bars, was about 100 ksi. The specimens showed no sign of erosion when viewed under a low magnification stereo-microscope. The density of the parts was about 7.87 g/cm$^3$, or nearly full density. The microstructure as determined by etching a polished cross section taken from the vicinity of the fractured area, with 2% nital showed that the copper had diffused into the steel particles to an average depth of about 2.5 micrometers. The determination of the diffusion depth of copper by electron dispersive X-ray analysis gave a depth value of about 4 micrometers. The reason for the different values for the two methods lies in the fact that the concentration of the copper within the steel matrix particles decreases from the outside towards the inside of a particle and the distinction by chemical etching disappears below a critical copper concentration. Thus, chemical etching gives lower figures in comparison to EDXA, but it is a more convenient, practical, and less expensive method than EDXA.

EXAMPLE 2

Samples were prepared following the procedure of Example 1, except that the green specimens were pressed to a density of 7.05 g/cm$^3$ rather than 6.7 g/cm$^3$. Also, a slug weight of 14%, based on the matrix weight, was employed. And finally, infiltration times, i.e., times at 2050° F., were 4, 7, 30, and 90 minutes, respectively. The properties of these specimens are shown in the following table:

| Impact Bars # | Infiltration Time (minutes) | Unnotched Charpy Impact Strength Ft. Lbs. | Density g/cm$^3$ | Diffusion Depth of Copper into Steel Matrix: by Chemical Etching μm | Diffusion Depth of Copper into Steel Matrix: by EDXA μm |
|---|---|---|---|---|---|
| A1 | 4 | 129 | 7.72* | 1.5 | 3 |
| A2 | 4 | 198 | 7.78 | | |
| A3 | 4 | 191 | 7.79 | | |
| A10 | 7 | 170 | 7.87 | 2.5 | 4 |
| A11 | 7 | 169 | 7.88 | | |
| A12 | 7 | 191 | 7.88 | | |
| A22 | 30 | 137 | 7.88 | 5.0 | 11 |
| A23 | 30 | 148 | 7.90 | | |
| A24 | 30 | 134 | 7.90 | | |
| A29 | 90 | 111 | 7.87 | 7.5 | 20 |
| A30 | 90 | 95 | 7.86 | | |
| A31 | 90 | 114 | 7.87 | | |

*Incompletely infiltrated.

The ultimate tensile strength of the above specimens were all between 110 and 125 ksi, the lower values belonging to the short infiltration times, the higher ones to the long infiltration times. It is therefore, clear from the above data, that short time infiltration times with shallow depths of copper diffusion gives significantly improved impact strength without significant losses in tensile strength. The greatest loss in impact strength occurs during the first 15 to 30 minutes of infiltration. The above data also shows that density has little effect on strength. In fact, the higher impact strength parts obtained at shorter infiltration times generally had lower densities than the longer infiltrated parts.

EXAMPLE 3

This example was carried out following the procedure of Example 1, except that the slug to metal matrix ratio was varied from 7 to 21%. The results of this series of experiments are summarized in the following table:

| Impact Bar # | Unnotched Charpy Impact Strength Ft. Lbs. | Slug/Matrix Ratio % | Density g/cm$^3$ | Average Porosity %(1) | Maximum Porosity %(2) | Maximum Pore Size μm(2) |
|---|---|---|---|---|---|---|
| A41 | 35 | 7 | 7.08 | 10.3 | 15 | 150 |
| A43 | 53 | 15 | 7.59 | 3.8 | 8 | 110 |
| A46 | 72 | 17 | 7.73 | 2.1 | 6 | 90 |
| A50 | 92 | 18 | 7.76 | 1.6 | 5 | 80 |
| A51 | 138 | 19 | 7.85 | 0.5 | 2.5 | 70 |
| A55 | 133 | 20 | 7.86 | 0.4 | 2 | 70 |
| A59 | 173 | 21 | 7.86 | 0.4 | 2 | 70 |

NOTE:
(1)Determined from weight and dimensions of impact bars.
(2)Determined by quantitative image analysis by examining 50 frames.

These results demonstrate that it is possible through the use of short infiltration times to obtain impact strengths of over 50 ft. lbs. at an overall density as low as 7.59 g/cm$^3$, corresponding to an average porosity of 3.8%. The ultimate tensile strengths of dog bone tensile specimens treated the same way were about 100 ksi. This data, however, also shows that the best results are obtained by meeting the porosity and pore size criteria of copending application U.S. Pat. No. 4,606,768 namely, less than 7 volume percent and 125 micrometers. Optimum results are obtained by infiltration to a worst field of view porosity of less than 5 volume percent and a maximum pore size of less than 75 micrometers.

EXAMPLE 4

Samples were prepared following the procedure of Example 2, except that the infiltration time was 7 minutes only, and the tempering temperature was 350° F. instead of 1300° F. The unnotched Charpy impact strengths varied from 25 to 28 ft. lbs., and the ultimate tensile strengths were above 184 ksi. At such high tensile strengths, conventional copper infiltration of steel typically gives impact strengths of less than about 10 ft. lbs.

EXAMPLE 5

Samples were prepared as in Example 1, except that pressed density of the steel skeleton was 7.04 g/cm$^3$, tempering temperatures were 1150° F. and 1300° F.; and infiltration times were 5, 30, and 90 minutes.

| | Infiltration Time (Minutes) 5 | | 30 | | 90 | |
|---|---|---|---|---|---|---|
| Tempering Temperature, °F. | 1150 | 1300 | 1150 | 1300 | 1150 | 1300 |
| Unnotched Charpy Impact strength, ft. lbs. | 61 | 175 | 53 | 139 | 35 | 98 |
| Ultimate tensile strength, ksi | 154 | 110 | 155 | 115 | 150 | 122 |

EXAMPLE 5 (Continued)

These results deomonstrate the importance of heat treatment. Increase in tempering temperature up to about 1300° F. improves impact strength at the expense of tensile strength. Specimens tempered at 1300° F. The data also shows that short infiltration times give significant improvements in impact strength at various tempering temperatures. Ultimate tensile strength shows only a weak increase with length of infiltration.

EXAMPLE 6

Samples were prepared as in Example 5, except that the water atomized iron powder A-1000 was replaced by the high purity iron powder A-1000 SP (also manufactured by and available through Hoeganaes Corp.); the zinc stearate (lubricant) was replaced by Acrawax (manufactured by Glyco, Inc.); and the South Western graphite 1651 was replaced by Lonza 25 graphite manufactured by Lonza). An infiltration time of 5 minutes and tempering at 1300° F. gave impact values of 223; 240; 240 ft. lbs. (240 ft. lbs. was the testing limit of the impact testing machine).

These data are significantly superior to the 175 ft. lbs. reported in Example 5 for the corresponding set of conditions. This beneficial effect is attributed to the improved cleanliness of the various materials, i.e., lower oxide inclusion content and lower amount of residual ashes of the graphite and lubricant after sintering. It is important to stress that the improvement possible with these materials is absent if infiltration is done in accordance with conventional processing and it becomes increasingly active or noticeable as the various precautions of this invention as well as U.S. Pat. No. 4,606,768 are being implemented.

EXAMPLE 7

Samples were prepared as in Example 1, except that pressing of the steel matrix was carried out to a density of 7.04 g/cm$^3$, the infiltrant slug weight was 14% with respect to that of the steel matrix, and sintering was done for 30 minutes in hydrogen. Also, infiltration was done for 7 minutes at 2050° F. in hydrogen.

Unnotched Charpy impact strength was 141 ft. lbs. (average of 3 specimens) and ultimate tensile strength was 114 ksi. These data demonstrate that it is possible to obtain excellent combinations of impact and tensile strength by sintering and infiltrating in a reducing atmosphere rather then under vacuum.

The above Examples demonstrate that it is possible to obtain impact toughness several times as high as reported in the literature. While we do not intend to be limited to particular explanations of our results, we believe that longer infiltration times result in greater diffusion depths of copper into the steel matrix which produces a thicker and harder layer of material enveloping the iron and constraining plastic deformation which in turn results in a reduced impact strength.

Copper is known to precipitation harden iron or steel. The higher the concentration of copper and the greater the depth copper is found in the iron, the thicker and harder is the layer of material enveloping the iron core and restraining plastic deformation, in turn reducing impact strength.

Figure 1:
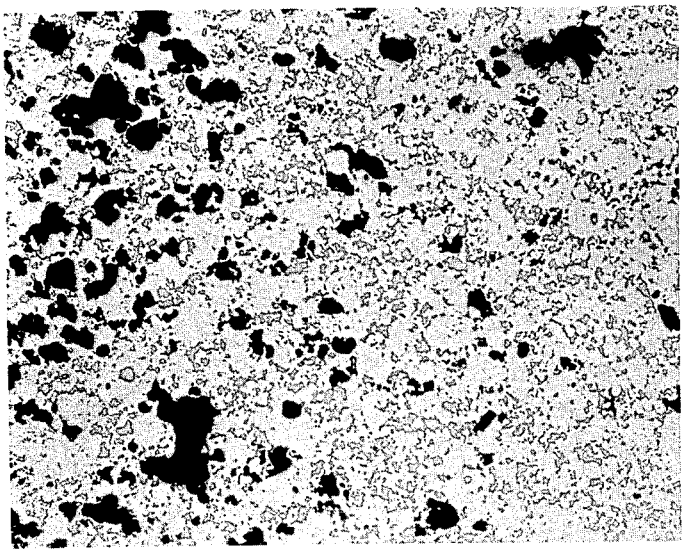
FIG. 1 is a field of view photomicrograph at 50 magnification, showing a plain, polished cross-section of a specimen part having high localized porosity.
Figure 2:
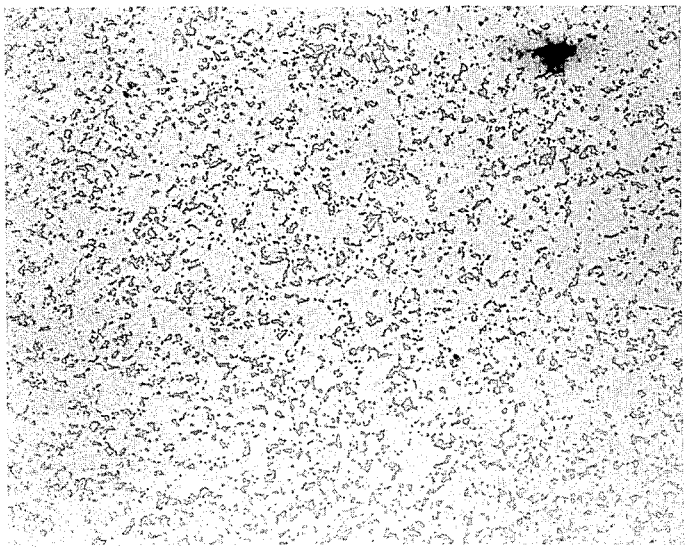
FIG. 2 is a field of view photomicrograph at 50 power, of a specimen prepared in accordance with the concepts of the present invention, specifically a specimen prepared by the procedure of Example 1.

FIG. 1 shows the microhardness profile through a steel particle taken from a specimen that had been infiltrated for 90 minutes, austenitized, quenched, and tempered at 1300° F. The higher hardness at both sides of the iron particle is evident.

The following Examples illustrate the importance of the presence of carbon in the steel matrix.

EXAMPLE 8

Samples were prepared as in Example 1, except that the iron powder was A1000SP (marketed by Hoeganaes Corporation), the graphite was "Graphite 2.5", manufactured by Lonza, and the lubricant was "Acrawax C", trademark of Glyco, Inc. Also, the amount of graphite addition was varied from 0 to 0.9%. The results are shown in the following table:

| Impact Bar # | Carbon Content % | Unnotched Charpy Impact Strength Ft. Lbs. |
|---|---|---|
| A118 | 0 | 240 |

-continued

| Impact Bar # | Carbon Content % | Unnotched Charpy Impact Strength Ft. Lbs. |
|---|---|---|
| A127 | 0.1 | 240 |
| A137 | 0.3 | 106 |
| A138 | 0.9 | 218 |

Although the samples with zero percent and 0.1% added carbon had the highest impact strengths, the ultimate tensile strengths for these specimens were very low, about 50 ksi. By contrast, the specimen with about 0.9% carbon had a tensile strength of about 100 ksi. In the range between about 0.3% carbon and 0.9% carbon, the impact and ultimate tensile strengths increased simultaneously.

These and other results indicate that attractive combinations of both impact and ultimate tensile strength can be obtained with added carbon contents higher than about 0.3%, and that a broad range in the practice of the present invention exists in the area between about 0.3 to about 1.4% added carbon, an optimum range being between about 0.4 and about 1.2%. In terms of combined carbon, these ranges are about 0.15–1.25 and 0.25–1.05%, respectively. These carbon contents as mentioned above are based on the weight of the steel skeleton not including the weight of copper.

The data of this Example is plotted in FIG. 3. It shows the impact strength decreasing to a minimum at about 0.3% added carbon and then increasing back to a maximum at about 0.9% added carbon. The increase of ultimate tensile strength with carbon content is expected. However, the increase of impact strength from the minimum at 0.3% added carbon to the maximum at 0.9% added carbon, was not expected.

One would expect that impact strength would decrease with increased carbon content. FIG. 3 also contains impact strength data taken from MPIF Standard 35. These data reflect widely used and typical industrial practice in the preparation of infiltrated iron powder metal parts. The data of Standard 35, in addition to being low, by comparison with the data of Example 8, show a steady and continual decrease with increasing carbon content.

This tendency toward lower impact strengths with increased carbon in fact is well known with other steels and has been plotted for conventional (100% dense) plain carbon steels. Reference in this respect can be had to FIG. 41, on page 1120 of the publication "The Making, Shaping and Treating of Steel", published by United States Steel, 9th Edition, 1971. The Charpy impact values in the Figure decrease with carbon content as follows

| Carbon Content % | Charpy Impact Ft. Lbs. |
|---|---|
| 0.2 | 40 |
| 0.3 | 25 |
| 0.5 | 10 |
| 0.7 | 5 |
| 0.9 | 3.5 |
| 1.1 | 2 |
| 1.3 | 1 |

The decrease in impact strength is most pronounced as the added carbon content is increased from 0.2 to about 0.5–0.7%, with the curve tapering off to near zero impact strength as the added carbon content passes about 1.1%.

Accordingly, referring back to the present FIG. 3, one would expect that the curve of Example 8 would follow the same pattern with the impact strength decreasing continuously with carbon content eventually approaching zero as the added carbon content exceeds about 1.0%. In fact, initially the impact strength does decrease, as shown, but then, surprisingly, at the minimum at about 0.3% added carbon, the strength, instead of continuing to decrease, climbs to a maximum at about 0.9% added carbon.

Although the reason for this is not known, it is believed that the increasing amount of carbon increasingly inhibits the diffusion of the copper into the steel particle. This produces the same effect achieved by shorter infiltration time, namely, holding copper diffusion to the parameters stated herein. However, more than that, it is believed that this positive aspect of the carbon content, as the content increases above about 0.3%, begins to outweigh the negative effect of carbon content on impact strength. At the same time the benefit of improved ultimate tensile strength with increased carbon content is essentially unaffected, i.e., the ultimate tensile strength continues to increase with increasing carbon content, giving the desired attractive combinations of both properties.

EXAMPLE 9

Samples were prepared as in Example 1, except that the amount of graphite addition was varied from 0 to 1.2% and infiltration time was 30 minutes. The results are shown in the following table:

| Impact Bar # | Carbon Content % | Unnotched Charpy Impact Strength Ft. Lbs. |
|---|---|---|
| I79 | 0.3 | 57 |
| I109 | 0.6 | 64 |
| I865 | 0.9 | 82 |
| I851 | 1.2 | 51 |

The ultimate tensile strengths of dogbone tensile bars processed the same way increased from about 55 to 110 ksi as the carbon content increased from 0 to 0.9%. At an added carbon content of 1.2%, the tensile strength was about the same as at 0.9% C. If tempering is performed at a lower temperature, for instance at 350° F, ultimate tensile strength for a carbon content of 0.9% increased to about 180 ksi. This increase in tensile strength obtains, of course, at the expense of impact strength as documented in Example 4.

The data of this Example are also plotted in FIG. 3. The data follow the same pattern as that of Example 8, showing both minimum and maximum points and an optimum range between about 0.4 and 1.2% added carbon, except in a less pronounced fashion. The data thus show that the surprising and beneficial affect of carbon content on impact strength pertains to relatively long infiltration times as well as short infiltration times, although optimum results are achieved by the use of short infiltration time in combination with an added carbon content of more than about 0.3%.

The diffusion depth in all of the samples of this Example exceeds the diffusion depth limits or parameters claimed herein. For instance, Sample 1865 had a diffusion depth of about 11 micrometers, as measured by EDXA. However, this sample did meet the microstructre requirements specified in U.S. Pat. No. 4,606,768.

The following Examples illustrate advantages of the present invention using an alloy iron powder, wherein the alloy inhibits copper diffusion.

EXAMPLE 10

Samples are prepared as in Example 1, except that 0.15% boron, in the form of a ferroboron alloy powder, is added to the iron powder; and sintering and infiltrating are done in a single step process under the conditions shown in Example 1, but for about thirty minutes. The presence of the boron reduces the diffusion of copper into the steel skeleton and the resulting combination of tensile and impact strength is superior to the one obtained without the presence of boron. Other interstitials or additives, such as nitrogen and silicon, can achieve the same result.

EXAMPLE 11

Samples were prepared as in Example 1, except that 1.5% of a −325 mesh copper powder was added in addition to the other components, and the powder blend was compacted to a density of 6.79 g/cm$^3$ and the slug to metal ratio was only 18%. Also, the skeleton sintering time was 90 minutes, whereas, the infiltration time was 5 minutes. The tempering temperature was 1150 F.

The Charpy unnotched impact strength was 82 ft. lbs. and the ultimate tensile strength about 110 ksi.

This Example demonstrates that a small amount of copper, if fairly uniformly diffused throughout the steel skeleton, is permissible for the attainment of improved combinations of tensile and impact strength.

In all of the above Examples, the procedure of sintering and then infiltrating, in two steps, is employed. It is possible to practice the present invention with a single step sintering and infiltration process.

This gives certain economies in utilities and furnace operation. However, better results appear to be obtainable by carrying out the sintering and infiltration in two steps rather than one, since the criteria in sintering and infiltration are not the same.

EXAMPLE 12

This Example illustrates single step sintering and infiltrating. Samples are prepared as in Example 5, except that both sintering and infiltration treatments were established by a single ('sintration') process. This process consisted of heating in a synthetic nitrogen ('UCAR') atmosphere with a holding time of 7 minutes at 1400° F. and 7 minutes at 2050° F. The impact strength (bar #87) was 90 ft. lbs. and the ultimate tensile strength approximately 100 ksi.

EXAMPLE 13

Samples wre prepared as Example 6 except the parts were pressed to 6.7 g/cm$^3$ and were sintered at 2050° F. for 30 minutes under an atmosphere of dissociated ammonia with a dewpoint of −40° F. at atmospheric pressure. Specimens were then infiltrated with a slug weighing 19½% of the iron specimen weight in dissociated ammonia with a dewpoint of −40° F. Impact strengths for three specimens were 124, 123, and 135 ft. lbs.

EXAMPLE 14

Samples were prepared as Example 2 except the bars were simultaneously sintered and infiltrated ("sintration") under a UCAR synthetic nitrogen based atmosphere with a dewpoint of 10 to 15° F. at atmospheric pressure (sold by Linde Division of Union Carbide) at 2050° F. for 7 minutes. The slug weight was 15% of the iron specimen weight. Impact strength for two specimens was 67 and 63 ft. lb.

In Example 13 and 14 above, we have shown that gaseous atmospheres of a material or mixture of materials inert or reducing to the powdered metal parts under conditions of sintering and/or infiltrating may be used. Any inert or reducing gas or mixture of gases may be used. "Synthetic nitrogen" is formed by thermal decomposition of methanol in the presence of variable amounts of nitrogen and contains carbon dioxide, carbon monoxide, hydrogen and nitrogen. Dissociated ammonia is formed by the thermal decomposition of ammonia and yields a gas containing nitrogen, hydrogen and possibly traces of ammonia. These are commercially available gases which are relatively inexpensive and are, therefore, atmospheres of choice. Any inert or reducing gas or gas mixture, e.g., argon, helium, with or without hydrogen and/or carbon monoxide, etc., or mixtures thereof with nitrogen, etc., may be used, if desired with comparable results although considerably more expensive. When a gaeous atmosphere is used, ambient pressure is generally utilized, e.g., 1 atmosphere pressure, although higher or lower pressures may be used. The gas or gas mixture is generally relatively dry, e.g., preferably having a dewpoint less than about 35° F., although dewpoints as high as 60° F. may be used.

Where nitrogen is present in the gas mixture, there is some tendency to react with the iron to form nitrides. However, this has been found to be very slight and thus insignificant to the results obtained. Also, where carbon monoxide and carbon dioxide are present in the gas mixture, the quantities of each should be thermodynamically balanced and take into account the carbon content of the powdered metal. A preponderance of carbon dioxide can cause oxidation of deleterious amounts of iron, whereas an excess of carbon monoixde can cause reduction to carbon and effect perhaps harmful change in the carbon content. If, however, these gases are thermodynamically balanced in the system the deleterious tendencies are cancelled out and the gas remains relatively inert.

The sintering or infiltrating steps may, as indicated above, be carried out sequentially or simultaneously. Where carried out sequentially, different atmospheres may be used for each operation, or either of them performed under vacuum while the other is performed under one of the inert or reducing gas atmospheres. Thus, for example, sintering may be performed under vacuum followed by infiltration is carried out in a dissociated ammonia gas atmosphere, or in a "synthetic" nitrogen atmoshere. Alternatively, sintering may be performed under an inert or reducing gas, e.g., dissociated ammonia, and the subsequent infiltration step done under vacuum.

What is claimed is:

1. A copper infiltrated ferrous powder metal part infiltrated with copper or a copper alloy characterized as having after infiltration an overall density of at least 7.50 g/cm$^3$ and a diffusion depth of copper into the steel matrix of less than about 4 micrometers as determined by chemical etching or less than about 8 micrometers as determined by electron dispersive X-ray analysis, wherein said ferrous metal is plain carbon steel having a combined carbon content in the range of about 0.15% to about 1.25%.

2. The metal part of claim 1 wherein said diffusion depth is less than about 3 micrometers as determined by chemical etching or less than about 5 micrometers as determined by electron dispersive X-ray analysis.

3. The metal part of claims 1 or 2 wherein said ferrous metal is plain carbon steel having a combined carbon content in the range of about 0.25% to about 1.05%.

4. The metal part of claim 1 having an overall density of at least 7.50 g/cm$^3$, a residual uninfiltrated porosity of not more than 10 volume percent, and a maximum pore size of the residual uninfiltrated porosity of less than about 120 micrometers, said porosity and pore size values being taken from the worst field of view in a functionally critical area of said metal part.

5. The metal part of claim 4 having a Charpy unnotched impact strength of greater than 50 ft. lbs. and an ultimate tensile strength greater than 60 ksi.

6. The metal part of claim 1 having an impact strength, as measured by the unnotched Charpy test, of greater than 13 ft. lbs., and a tensile strength of greater than 125 ksi.

7. A process for infiltrating ferrous powder metal parts with a copper or copper alloy infiltrant to yield an impact strength as measured by the unnotched Charpy test, of greater than 50 ft. lbs., and an ultimate tensile strength of greater than 60 ksi, comprising the steps of:

(a) pressing a ferrous powder metal to a density of at least about 80% of theoretical density;

(b) sintering said powder metal; and (c) infiltrating said powder metal with a copper or copper alloy infiltrant assuring that the depth of copper diffusion into the steel matrix as measured by chemical etching is less than about 4 micrometers, or less than about 8 micrometers when determined by electron dispersive X-ray analysis, wherein said ferrous metal is plain carbon steel having a combined carbon content in the range of about 0.15% to about 1.25%.

8. The process of claim 7 wherein said sintering is carried out under vacuum conditions or under a hydrogen atmosphere.

9. The process of claim 8 including the step of heat treating said metal part by austenitizing and tempering.

10. The process of claims 8 or 9 wherein said ferrous metal is plain carbon steel having a combined carbon content in the range of about 0.25% to about 1.05%.

11. The process of claims 8 or 9 wherein said infiltrant is copper alloyed with an alloying constituent selected from the group consisting of iron, tin, zinc, silver, lithium, silicon, manganese, chromium, zirconium, and combinations thereof.

12. A copper infiltrated ferrous powder metal part as claimed in claim 1 prepared by the steps of (a) filling a die with ferrous powder metal to achieve uniform powder metal distribution in said die;

(b) pressing said powder metal to a density of at least about 80% of theoretical density;

(c) sintering said powder metal; and (d) infiltrating said powder metal with a copper or copper alloy infiltrant assuring that the depth of copper diffusion into the steel matrix as measured by chemical etching is less than about 4 micrometers, or less than about 8 micrometers when determined by electron dispersive X-ray analysis.

13. A copper infiltrated ferrous powder metal part as claimed in claim 1 prepared by the steps of (a) filling a die with ferrous powder metal to achieve uniform powder metal distribution in said die;
(b) pressing said powder metal to a density of at least about 80% of theoretical density;
(c) sintering said powder metal under vacuum sintering conditions or a hydrogen atmosphere using conditions effective for sintering; and
(d) infiltrating said powder metal also under vacuum sintering conditions or a hydrogen atmosphere using conditions effective for infiltrating, with a copper or copper alloy infiltrant assuring that the depth of copper diffusion into the steel matrix as measured by chemical etching is less than about 4 micrometers, or less than about 8 micrometers when determined by electron dispersive X-ray analysis.

14. The copper infiltrated ferrous powder metal part of claim 1 prepared by presintering said metal part followed by copper infiltration.

15. A copper infiltrated ferrous powder metal part infiltrated with copper or a copper alloy characterized as having after infiltration an overall density of at least 7.50 g/cm$^3$ and a diffusion depth of copper into the steel matrix of less than about 4 micrometers as determined by chemical etching or less than about 8 micrometers as determined by electron dispersive X-ray analysis, wherein said ferrous metal is a low alloy or tool steel.

16. The metal part of claim 15 wherein said ferrous metal has a boron content in the range of about 0.1–0.2%.

17. A process for infiltrating ferrous powder metal parts with a copper or copper alloy infiltrant to yield an impact strength as measured by the unnotched Charpy test, of greater than 50 ft. lbs., and an ultimate tensile strength of greater than 60 ksi, comprising the steps of:
(a) pressing a ferrous powder metal to a density of at least about 80% of theoretical density;
(b) sintering said powder metal; and
(c) infiltrating said powder metal with a copper or copper alloy infiltrant assuring that the depth of copper diffusion into the steel matrix as measured by chemical etching is less than about 4 micrometers, or less than about 8 micrometers when determined by electron dispersive X-ray analysis, wherein said ferrous metal is a low alloy or tool steel.

18. The process of claim 17 wherein said ferrous metal has a boron content in the range of about 0.1–0.2%.

19. A copper infiltrated ferrous powder metal part as claimed in claim 15 prepared by the steps of:
(a) filling a die with ferous powder metal to achieve uniform powder metal distribution in said die;
(b) pressing said powder metal to a density of at least about 80% of theoretical density;
(c) sintering said powder metal; and
(d) infiltrating said powder metal with a copper or copper alloy infiltrant assuring that the depth of copper diffusion into the steel matrix as measured by chemical etching is less than about 4 micrometers, or less than about 8 micrometers when determined by electron dispersive X-ray analysis.

20. A copper infiltrated ferrous powder metal part as claimed in claim 15 prepared by the steps of:
(a) filling a die with ferrous powder metal to achieve uniform powder metal distribution in said die;
(b) pressing said powder mtal to a density of at least about 80% of theoretical density;
(c) sintering said power metal under vacuum sintering conditions or a hydrogen atmosphere using conditions effective for sintering; and
(d) infiltrating said powder metal also under vacuum sintering conditions or a hydrogen atmosphere using conditions effective for infiltrating, with a copper or copper alloy infiltrant assuring that the depth of copper diffusion into the steel matrix as measured by chemical etching is less than about 4 micrometers, or less than about 8 micrometers when determined by electron dispersive X-ray analysis.

21. The process of claim 7 wherein the sintering and infiltrating are carried out simultaneously.

22. The metal parts of claims 12 or 13 wherein the sintering and infiltrating are carried out simultaneoulsy.

23. A process for infiltrating ferrous powder metal parts witha copper or copper alloy infiltrant to yield an impact strength, as measured by the unnotched Charpy test, of greater than 50 foot pounds, and an ultimate tensile strength of greater than 46 ksi in the as-infiltrated condition, comprising the steps of:
(a) filling a die with ferrous powder metal to achieve uniform powder metal distribution in said die;
(b) pressing said ferrous powder metal to a density of at least about 80% of theoretical density;
(c) sintering said ferrous powder metal under an atmosphere of an inert gas or a reducing gas using conditions effective for sintering;
(d) infiltrating said ferrous powder metal with a copper or copper alloy infiltrant under an atmosphere of an inert gas with or without a reducing gas and assuring that th edepth of copper diffusion into the steel matrix as measured by chemical etching is less than about 4 micrometers, or less than about 8 micrometers when determined by electron dispersive X-ray analysis;
(e) the filling, pressing, sintering and infiltrating conditions being effective to provide a powder metal part having a residual uninfiltrated porosity and a maximum pore size of residual uninfiltrated porosity, as taken from a worst field of view in a functionally critical area of said metal part, of less than about 7 volume percent and 125 micrometers, respectively;

said ferrous powder metal following infiltration having a combined carbon content in the range of about 0.15% to about 1.25%.

24. A process as defined in claim 23 wherein the inert gas contains hydrogen.

25. A process as defined in claim 23 wherein the reducing gas is dissociated ammonia.

26. A process as defined in claim 23 wherein the reducing gas is "synthetic" nitrogen.

27. A process as defined in claim 23 wherein the inert gas is selected frm argon, helium and nitrogen.

28. A process as defined in claim 25 wherein the sintering step is carried out under vacuum.

29. A process as defined in claim 25 wherein the infiltrating step is carried out under vacuum.

30. A copper infiltrated ferrous powder metal part prepared by the steps of:
(a) filling a die with ferrous powder metal to achieve uniform powder metal distributionin said die;
(b) pressing said powder metal to a density of at least about 80% of theoretical density;

(c) sintering said powder metal under an inert or reducing gas atmosphere using conditions effective for sintering; and (d) infiltrating said powder metal also under an inert or reducing gas atmosphere using conditions effective for infiltrating, with a copper or copper alloy infiltrant assuring that the depth of copper diffusion into the steel matrix as measured by chemical etching is less than about 4 micrometers, or less than about 8 micrometers when determined by electron dispersive X-ray analysis.

31. The metal parts of claim 30 wherein the sintering and infiltrating are carried out simultaneously.

32. The metal parts of claim 30 wherein the reducing gas atmosphere is dissociated ammonia.

33. The metal parts of claim 30 wherein the reducing gas atmosphere is "synthetic" nitrogen.

34. The metal parts of claim 30 wherein the inert gas is selected from argon, helium, and nitrogen.

35. The metal parts of claim 30 wherein the sintering step is carried out under vacuum.

36. The metal parts of claim 30 wherein the infiltrating step is carried out under vacuum.

37. A process for infiltrating ferrous powder metal parts with a copper or copper alloy infiltrant to yield an impact strength, as measured by the unnotched Charpy test, of greater than 50 foot pounds, and an ultimate tensile strength of greater than 46 ksi, in the as-infiltrated condition, comprising the steps of:

(a) filling a die with ferrous powder metal to achieve uniform powder metal distribution in said die;

(b) pressing said ferrous powder metal to a density of at least about 80% of theoretical density;

(c) sintering sid ferrous powder metal under an inert gas atmosphere at ambient pressure using sintering conditions;

(d) infiltrating said ferrous powder metal with a copper or copper alloy infiltrant under an inert gas atmosphere at ambient pressure using infiltrating conditions;

(e) the filling, pressing, sintering and infiltrating conditions being effective to provide a powder metal part having a residual uninfiltrated porosity and a maximum pore size of residual uninfiltrated porosity, as taken from a worst field of view in a functionally critical area of said metal part, of less than about 7 volume percent and 125 micrometers, respectively;

said ferrous powder metal following infiltration having a combined carbon content in the range of about 0.15% to about 1.25%.

38. The process of claim 37 wherein the sintering and infiltrating are carried out simultaneously.

* * * * *